US005211769A

United States Patent [19]

Sobata et al.

[11] Patent Number: 5,211,769

[45] Date of Patent: May 18, 1993

[54] METHOD FOR PHOSPHATING METAL SURFACE WITH ZINC PHOSPHATE

[75] Inventors: Tamotsu Sobata; Akio Tokuyama; Shoji Shiraishi, all of Osaka; Seiichiro Shirahata, Kanagawa, all of Japan

[73] Assignee: Nippon Paint Co., Ltd., Osaka, Japan

[21] Appl. No.: 629,853

[22] Filed: Dec. 18, 1990

[30] Foreign Application Priority Data

Dec. 19, 1989 [JP] Japan ..... 1-330856
Feb. 17, 1990 [JP] Japan ..... 2-036432

[51] Int. Cl.[5] ..... C23C 22/36
[52] U.S. Cl. ..... 148/260; 148/262
[58] Field of Search ..... 148/262, 260

[56] References Cited

U.S. PATENT DOCUMENTS 4,053,328 10/1977 Oka et al. .
4,265,677 5/1981 Muller ..... 148/262
4,838,957 6/1989 Miyamoto et al. .
4,849,031 7/1989 Hauffe ..... 148/262

FOREIGN PATENT DOCUMENTS 627611 1/1953 Belgium .
0060716 3/1982 European Pat. Off. .
763628 4/1971 France ..... 148/262
2100616 3/1972 France .
2102374 4/1992 France .
4217632 7/1963 Japan .
55-5590 2/1980 Japan .
57-70281 10/1980 Japan .
57-152472 3/1981 Japan .
6136588 8/1982 Japan .
61104089 10/1984 Japan .
63-157879 9/1987 Japan .
64-68481 8/1988 Japan .
1011177 11/1965 United Kingdom .
1072427 6/1967 United Kingdom .
1297715 11/1972 United Kingdom .
1341902 12/1973 United Kingdom .

OTHER PUBLICATIONS

EP-381-190-A Aug. 8, 1990.

*Primary Examiner*—Sam Silverberg
*Attorney, Agent, or Firm*—Lowe, Price, LeBlanc & Becker

[57] ABSTRACT

To treat an iron-based, zinc-based, and an aluminum-based surfaces etc. with zinc phosphate using the same solution, a treating solution is adjusted in concentrations so as to contain a simple fluoride in a range of 200~500 mg/l upon converting into a HF concentration and to contain a fluoride complex in a range shown in the following formula;

$$0.01 \leqq \frac{\text{fluoride complex}}{\text{simple fluoride}} \leqq 0.5 \text{ (mole ratio)}$$

and also, it is adjusted in an active fluorine concentration so as to be 15~130 μA at a value indicated by a silicon electrode meter. Instead of such adjusting aluminum ions in the treating solution is precipitated in an outside of a treating bath to separate them from the treating solution and then, this treating solution may be returned into the treating bath.

1 Claim, 1 Drawing Sheet

METHOD FOR PHOSPHATING METAL SURFACE WITH ZINC PHOSPHATE

BACKGROUND OF THE INVENTION

The present invention relates to a method for treating (phosphating) a metal surface with zinc phosphate being provided for coating etc. and, in detail, to a phosphating method for forming a zinc phosphate coating film on an iron-based, zinc-based, and an aluminum-based surfaces as well as a metal surface having these two or more surfaces in combination and simultaneously, wherein the coating film is desired to be suitable for electrocoating, in particular, for electrocoating of a cation type and to be superior in the adhesion character, corrosion-resistance, in particular, in warm brine-resistance and resistance for rust of a scab type (hereinafter, referred to as scab-resistance).

Metal materials have been used in various fields such as automobile bodies and other automobile parts, building materials, furniture and so no. The metals are treated with zinc phosphate (phosphating) as a coating pre-treatment in order to prevent corrosion due to oxygen, sulfur oxides in the air, rain water, and sea water etc. The zinc phosphate coating film thus-formed requires adhesion-superiority with a metal surface that is a substrate and with a coating film thereon formed (secondary adhesion) as well as to have sufficient rest-resistance even under corrosive surroundings. In particular, since the automobile body repeatedly suffers contact of brine and variation of weather conditions (dry or wet) at a wounded place of the outside plate, it is desired to have scab-resistance and a higher degree of warm brine-resistance.

Recently, there are increasing the cases of treating metal materials composed of two or more kinds of metal surfaces with zinc phosphate. For example, in order to further elevate corrosion-resistance of the automobile body after the coating, a zinc- or zinc alloy-plated material is used in only one side of steel materials. Like this, when the hitherto known phosphating treatment with zinc phosphate is carried out for a metal surface having both an iron-based and zinc-based surfaces, there is caused a problem that the corrosion-resistance and secondary adhesion on the zinc-based surface is inferior compared with those on the iron-based surface. Because of this, there has been proposed, for example, in Japanese Official Patent Provisional Publication, shows 57-152472 etc., a method of forming a zinc phosphate coating film which is suitable for electrocoating on a metal surface having both an iron-based and zinc-based surfaces simultaneously. In this method, manganese ions in a concentration of 0.6~3 g/l and/or nickel ions in a concentration of 0.1~4 g/l are contained in a treating bath wherein the concentrations of zinc ions, phosphate ions, and a coating film-converting accelerator are controlled. Also, there has been proposed in Japanese Official Patent Gazette, shows 61-36588, an art wherein fluorine ions are added in a concentration of 0.05 g/l or more, together with manganese ions in order to lower treating temperature.

Also, a material composed of an aluminum material combined with an iron or zinc material has practically been used in various fields such as the automobile and building materials etc. When the kinds of materials are treated with an acidic, treating (phosphating) solution for forming a zinc phosphate coating film, aluminum ions dissolving into the treating solution is accumulated and, if its amount increases to a certain extent, there is a problem of inferior conversion which takes place on an iron-based surface. That is, if the aluminum ions increase up to a concentration of 5 ppm or more in a treating solution not containing the fluoro ion, to a concentration of 100 ppm or more in a treating solution containing $HBF_4$, and to a concentration of 300 ppm or more even in a treating bath containing $H_2SiF_6$, there has been found conversion inferiority on an iron-based surface.

Thus, in order to prevent the increase of aluminum ions in a treating solution, there has been proposed in Japanese Official Patent Provision Publication shows 57-70281, a method wherein the aluminum ions are precipitated as a form of $K_2NaAlF_6$ or $Na_3AlF_6$ by adding acidic potassium fluoride or acidic sodium fluoride to the treating solution. Also, there has been proposed in Japanese Official Patent Provision Publication, shows 61-104089, a method wherein proportion of an aluminum-based surface area to an iron-based surface area is controlled to 3/7 or less and the aluminum ion concentration in a treating solution of fluorine-based zinc phosphate is maintained at 70 ppm or less.

On the other hand, a method of forming a zinc phosphate coating film on an aluminum-based surface and being provided for cationic electrocoating has been proposed, for example, In Japanese Official Patent Provisional Publications, shows 63-157879 and 64-68481. In the former publication, there has been disclosed a method wherein a metal surface is brought in contact with a treating solution for forming zinc phosphate coating film which contains a fluoride [F (el)], when measured with a fluorine ion-sensitive electrode, in a concentration of 80~200 mg/l and an acidity of the free acid is adjusted in proportion to the F (el) concentration. In the latter publication, there has been disclosed a method wherein a metal is brought in contact with an aqueous treating solution for forming zinc phosphate coating film containing said F (el) in a concentration of 80~400 mg/l and proportion of the free acid to the total acid is adjusted in a ration of (0.02~0.15):1.

The method for treating with the zinc phosphate which was described in Japanese Official Patent Provisional Publication, shows 61-104089, has a disadvantage so that a treating object is very limited and also, it is difficult to maintain the aluminum ion in a concentration of 70 ppm or less by only controlling the area proportion as described above. In contrast, the treating method which was described in Japanese Official Patent Provisional Publicaion, shows 57-70281, is superior in a point of view that it does not limit a treating object, but remove aluminum ions from a treating solution with precipitating. However, the precipitate here formed shows a trend of floating and suspending and attaches to a zinc phosphate coating film causing ununiformity. Because of this, in a case where an electrocoating is carried out on a zinc phosphate coating film, an inferior electrocoating takes place which becomes an origin for causing lack of uniformity and bad secondary adhesion of a coating film etc. Thus, it is necessary to remove the precipitate of floating and suspending character, but this removing process is complicate.

Also, in the methods for treating with the zinc phosphate which were described in Japanese Official Patent Provisional Publications, shows 63-157879 and 64-68481, because the $Na_3AlF_6$ component mingles with a zinc phosphate coating film on an aluminum-based surface, the brine-resistant spraying test and warm brine-resistance of an cationic electrocoating film are bad. Thus, to get a satisfactory quality in a practical use, it is necessary to carry out an after-treatment by a chromium (VI)-containing rinsing solution after the zinc phosphate treatment. The solution containing the chromium (VI) is troublesome in handling and disusing.

SUMMARY OF THE INVENTION

Accordingly, a subject of the present invention is to provide a method for treating a metal surface with zinc phosphate wherein an iron-based surface, zinc-based surface, and an aluminum-based surface as well as a metal surface having two or more kinds of these surfaces at the same time can be treated with the treating solution of an identical kind and the same and, even if the treating is repeated many times, a coating film of excellent adhesion and high corrosion-resistance can be formed under a stable condition, and also, a rinsing solution containing the chrominum (VI) is not necessary in order to get the forementioned coating film of high corrosion-resistance.

To solve said subject, a method for treating a metal surface with zinc phosphate relating to the present first invention is characterized by that a treating solution for forming a zinc phosphate coating film (hereinafter, the term "a treating solution (1)" means "a treating solution for forming a zinc phosphate coating film" using in the first invention.), with which a metal surface containing aluminum is brought in contact, is adjusted so as to contain a simple fluoride in a concentration range of 200~500 mg/l upon converting the fluoride into a HF concentration, a fluoride complex of which concentration is adjusted as shown in the formula:

$$0.01 \leqq \frac{\text{fluoride complex}}{\text{simple fluoride}} \leqq 0.5 \text{ (mole ratio)}$$

and an active fluorine of which concentration is adjusted so as to indicate a value in a range of 15~130 μA by a silicon electrode meter.

If the simple fluoride, fluoride complex, and active fluorine concentrations are all in the above-mentioned range, aluminum ions which dissolved into the treating solution (1) form a water-insoluble fluoride complex (sludge containing aluminum) accompanied with treatment of a metal surface having an aluminum-based surface, so that an aluminum ion concentration in the treating solution is maintained with stability, for example, at 150 ppm or less.

Because of this, a superior coating film of high corrosion-resistance can be formed on the surface based on aluminum and the surfaces based on iron and/or zinc successively and with stability. Since said water-insoluble fluoride complex has a sedimentation character (favorably, a good sedimentation character), it quickly sets down without floating and suspending, so that it can be easily removed by a common separation method of precipitate.

To solve said subject, a method for treating a metal surface with zinc phosphate of the present second invention comprises bringing a metal surface containing aluminum in contact with a treating solution for forming a zinc phosphate coating film (hereinafter, the term "a treating solution (2)" means "a treating solution for forming a zinc phosphate coating film" used in the second invention.) placed in a treating bath in order to form a zinc phosphate coating film on the metal surface; and is characterized by that said treating solution (2) in the treating bath is led to an outside of the bath, a simple fluoride is added to the treating solution (2) at said outside of the bath to precipitate aluminum ions in the treating solution (2), a precipitate thus-formed is separated form the treating solution (2), and this treating solution is returned to said treating bath.

Accompanied with treatment of a metal surface having an aluminum-based surface, aluminum ions dissolve into the treating solution (2). On standing at this state, the aluminum ions continue to increase in the treating solution placed in the treating bath and form sludge containing aluminum which is a water-insoluble fluoride complex. Then, the treating solution (2) is led to an outside of the treating bath and, if at this outside a simple fluoride is added to the treating solution (2) to precipitate the aluminum ions, the concentration of aluminum ions is easily reduced. A precipitate thus-formed (in this case, sludge containing aluminum) can be separated from the treating solution by a desirable means. Since formation and separation of the precipitate is carried out in an outside of the treating bath, attaching of the precipitate to a treating object in the treating bath can be prevented. After separating the preipitate, the treating solution is returned to the treating bath. By doing this, the treating solution (2) containing aluminum ions in the treating bath is diluted with a treating solution from which aluminum ions are selectively removed, so that a concentration increase of the aluminum ions is depressed and a loss of other components is prevented. Thus, a superior coating film of high corrosion-resistance can be formed continuously and under a stable condition on an aluminum-based surface and an iron-based and/or zinc-based surfaces.

Upon considering theses points, it is recommended that the aluminum ion concentration in the treating solution (2) placed in the treating bath is maintained at 150 ppm or less. For example, a sensor to survey the aluminum ion concentration is set in the treating bath and, when the aluminum ion concentration in the treating solution (2) in the treating bath exceeds a certain set value, the treating solution is continuously or intermittently, by pumping etc., led to an outside of the treating bath and, after selective removal of the aluminum ions is carried out as described above, the treating solution is returned to the treating bath, and thus the aluminum ion concentration in the treating bath can be kept at a desirable value, for example, 150 ppm or less.

The metal surface, that is an object of the methods for treating with zinc phosphate in the prevent invention, is a metal surface containing aluminum, for example, a surface based on aluminum (for example, a surface of at least one of aluminum and aluminum alloys; and a surface of alloys containing aluminum in a relatively high percentage except the aluminum alloys), and a metal surface having jointly at least one of these surfaces and one or more of a surface based on iron, a surface based on zinc, and others.

The shape of the metal surface by be a flat plate, a part having a bag structure, or other kinds of structures, and it is not especially limited. According to the present invention, an inside surface of the bag structure part can be treated in a similar way as an outside of the part and a flat plate are treated.

The concentration of a simple fluoride in a treating solution (1) used in the present first invention is necessary to be adjusted in a range of 200~500 mg/l upon converting into the HF concentration and preferable, in a range of 300~500 mg/l. If the concentration of a simple fluoride is less than 200 mg/l, because the aluminum ions form a water-soluble fluoride complex, the aluminum ion concentration in the treating solution (1) increases and with this, bad conversion takes place. If the concentration of a simple fluoride exceeds 500 mg/l, the $Na_3AlF_6$ component mingles with a zinc phosphate coating film on an aluminum-based surface, so that the warm brine-resistance of a cationically electrocoated film lowers.

The concentration of a fluoride complex in a treating solution (1) is necessary to be adjusted in a range as shown in the formula;

$$0.01 \leqq \frac{\text{fluoride complex}}{\text{simple fluoride}} \leqq 0.5$$

in the mole ratio of the fluoride complex to the simple fluride upon converting in to a HF. Here, an fluoride complex containing aluminum is not included as the fluoride complex. If the fluoride complex becomes in excess exceeding 0.5 in a mole ratio of the fluoride complex to the simple fluoride, the aluminum ions dissolving into the treating solution (1) forms a water-soluble fluoride complex, so that the aluminum ion concentration in the treating solution (1) increases and with this, bad conversion takes place. Besides, if an insoluble fluoride complex is formed, because of the floating and suspending character, its separation by precipitating becomes difficult and it attaches to a treating substrate and becomes an origin to cause an inferior electrocoating (for example, lacking of film-uniformity and deterioration of corrosion-resistance in a coating film etc.). If the mole ratio is less than 0.01, the $Na_3AlF_6$ component mingles with a zinc phosphate coating film on an aluminum-based surface, so that the warm brine-resistance of a cationically electrocoated film lowers.

The active fluorine concentration of a treating solution (1) needs to be adjusted so as to indicate a value in a range of 15~130 μA by a silicon electrode meter and, preferably, a range of 40~100 μA. However, if the concentration is adjusted at a value in a range of 15~130 μA being indicated by a silicon electrode meter, it is unnecessary to actually measure the active fluorine concentration by a silicon electrode meter and it is possible to adopt another concentration measurement method. The silicon electrode meter has advantages of showing a high sensitivity in a pH range (an acidic area) of the treating solution for forming a zinc phosphate coating film using in the present invention and indicating a value which becomes larger in proportion to an active fluorine concentration. If the value indicated is less than 15 μA, an uniform zinc phosphate coating film is not formed on an aluminum-based surface and the aluminum ions dissolved into the treating solution (1) form a water-soluble fluorine complex, so that the concentration of aluminum ions in the treating solution (1) increases and, with this, bad conversion takes place. If the value indicated exceeds 130 μA, the $Na_3AlF_6$ component mingles with a zinc phosphate coating film on an aluminum-based surface and the warm brine-resistance and brine-resistance spraying test of a cationically electrocoated film lowers.

In a treating solution (2) using in the present invention, it is preferred that a concentration of the simple fluoride is adjusted at 200 mg/l or more upon converting into a HF concentration and, more preferable is to be adjusted in a range of 200~300 mg/l, and it is preferred that a concentration of the fluoride complex is adjusted in a range of;

$$\frac{\text{fluoride complex}}{\text{simple fluoride}} \geqq 0.01 \text{ (mole ratio)};$$

in the mole ratio of the fluoride complex to the simple fluoride upon converting into the HF concentration and a concentration of the active fluorine is adjusted so as to indicate a value of 15~40 μA in a silicon electrode meter. Here, a fluoride complex containing aluminum is not included as the fluoride complex. If a concentration of the simple fluoride in the treating solution (2) in a treating bath is less than 200 gm/l, an uniform zinc phosphate coating film may not be formed on an aluminum-based surface because the active fluorine concentration is too low. On the other hand, to control the concentration of a simple fluoride in a range of 200~300 mg/l is preferable because precipitation-depressing of excess aluminum ions in the treating bath is possible. Also, if a mole ratio of the fluoride complex to the simple fluoride in a treating solution (2) in a treating bath is less than 0.01, the $Na_3AlF_6$ component may mingle with a zinc phosphate coating film on an aluminum-based surface, so that there is the possibility of decrease in the warm brine-resistance of a cationic electrocoating film. Also, if a concentration of the active fluorine in a treating solution (2) in a treating bath is less than 15 μA on a value indicated by a silicon electrode meter, there is the possibility of no formation of a uniform zinc phosphate coating film on an aluminum-based surface, and if it exceeds 40 μA, there is the possibility of increase in a precipitating trend of aluminum ions in the treating bath.

When the simple fluoride is added to a treating solution (2) led out from a treating bath, it is preferred that the mole ratio of the fluoride complex to the simple fluoride is adjusted to 0.5 or less and the concentration of active fluorine is adjusted to 40 μA or more on a value indicated by a silicon electrode meter. Upon adjusting these, since said sludge containing aluminum has a sedimentation character (preferably, a good sedimentation character), it quickly sets down without floating and suspending and can be easily removed by a common separating method of precipitate. From a point of that sludge containing aluminum of a sedimentation character is formed, it is more preferred that a concentration of said active fluorine is adjusted at 130 μA or more on a value indicated by a silicon electrode meter. Here, a fluoride complex containing aluminum is not included as the fluoride complex. If the fluoride complex becomes excess exceeding 0.5 in the mole ratio of said fluoride complex to the simple fluoride, the aluminum ions does not form the sludge containing aluminum of a sedimentation character (preferably, a good sedimentation character) and a water-insoluble character, but the sludge containing aluminum of a floating and suspending character and, therefore, separation by precipitating becomes difficult and, in a case of the separation by sedimentation, the sludge comes to a treating bath together with a treating solution and attaches to a treating object, so that it is apprehended that inferior electrocoating (for example, lacking of film-uniformity and deterioration of corrosion-resistance in a coating film etc.) takes place. If the concentration of active fluorine is less than 40 μA on a value indicated by a silicon electrode meter, because aluminum ions does not form the sludge containing aluminum of a good sedimentation character, the separation of precipitate becomes difficult and also, the concentration of aluminum ions in a treating solution increases and, accompanied with this, there is the possibility of occurrence of inferior converting.

Besides, by adjusting the concentrations of a simple fluoride, a fluoride complex, and an active fluorine in a treating solution (2) in an outside of a treating bath, it is possible to adjust these compounds in an inside of the treating bath in said range.

If the treating solutions using in the present invention are adjusted in the active fluorine concentration so that a value indicated by a silicon electrode meter is in the forementioned range, actual measurement by the silicon electrode meter is unnecessary and adoption of other concentration-measuring methods is also possible. The silicon electrode meter has an advantage of that it shows high sensitivity in a pH range of the treating solutions (an acidic region) using in the present invention, and of a large value indication relative to the active fluorine concentration.

There is, as said silicon electrode meter, the one described in Japanese Official Patent Gazette, shows 42-17632, but it is not limited by that one. The silicon electrode meter is as follows, for example, the one which is commertially distributed from Nippon Paint Co., Ltd. with a trade name of Surf Proguard 101N, and easily obtained. That is, this silicon electrode meter is set up so that, under a condition where a solution being measured is not shone with a light, a p-type silicon electrode (for example, having a 0.5 square inch area in contact with a solution) and a platinum-made unactive electrode are brought in contact with that solution, a direct electric current source is connected between these electrodes, and a value of the electric current is read. The solution placed in said vessel is still stood or arranged to make a constant current. Then, under these conditions, a direct electric current voltage (for example, a 1.2 volt D.C.) is charged between both the electrodes and the active fluorine concentration is known by reading a value of the electric current when it becomes to a stationary value.

As said simple fluoride (this word means a fluoride derivative of simple structure in contrast with the fluoride complex) are used, for example HF, NaF, KF, $NH_4F$, $NaHF_2$, $KHF_2$, and $NH_4HF_2$, etc., and as said fluoride complex are used, for example, $H_2SiF_6$, $HBF_4$, and these metal salts (for example, a nickel salt and a zinc salt), etc. To the treating solution (2) are usually added the simple fluoride in an outside of the treating bath and the fluoride complex in an inside and/or an outside of the treating bath.

In the treating solution (1) using in the present invention, if the concentrations of the simple fluoride, fluoride complex, and active fluorine are adjusted at conditions in said range, the kind and concentration of other components are set similarly to those of a common treating solution for forming a zinc phosphate coating film. Among these other components, a zinc ion, a phosphate ion, and a coating film-converting accelerator (a) need to be included, but the rest of components is properly arranged in case of necessity.

In the treating solution (2) using in the present invention, if the concentrations of the simple fluoride, fluoride complex, and active fluorine are adjusted, for example, at said concentrations, the kind and concentration of other components are set similarly to those of a common treating solution for forming a zinc phosphate coating film.

Among these other components, a zinc ion, a phosphate ion, and a coating film-converting accelerator (a) need to be included, but the rest of components is properly arranged in case of necessity.

Among the main components in the treating solutions for forming a zinc phosphate coating film using in the present invention, the components other than the simple fluoride, fluoride complex, and active fluorine are, for example, a zinc ion, a phosphate ion, and a coating film-converting accelerator (a). As the coating film-converting accelerator (a) is used at least one kind selected from the group consisting of a nitrite ion, a m-nitrobenzenesulfonate ion, and hydrogen peroxide. Preferable concentrations of these ions are, for example, as follows (more preferable concentrations are indicated in parentheses). The zinc ion is in a concentration range of 0.1~2.0 (0.3~1.5) g/l, the phosphate ion is in that of 5~40 (10~30) g/l, the nitrite ion is in that of 0.01~0.5 (0.01~0.4) g/l, the m-nitrobenzenesulfonate ion is in that of 0.05~5 (0.1~4) g/l, and the hydrogen peroxide is in that of 0.5~10 (1~8) g/l upon converting into a 100% $H_2O_2$. The free acid acidity (FA) is preferred if it is adjusted in a range of 0.5~2.0.

If the zinc ion concentration is less than 0.1 g/l, an uniform zinc phosphate coating film is not formed on a metal surface, many lack of hiding is found, and in part a coating film of a blue color type is sometimes formed. Besides, if the zinc ion concentration exceeds 2.0 g/l, an uniform zinc phosphate coating film is formed, but it is easily soluble in an alkali and, in particular, there is a case where the coating film is easily dissolved depending upon an alkali atmosphere where it is exposed during a cationic electrocoating. As a result, the warm brine-resistance generally lowers and, in particular, on an iron-based surface the scab resistance deteriorates and so on, and thus, because desired properties are not obtained, a coating film in this case is not proper as a substrate for an electrocoating, in particular, a cationic electrocoating.

If the phosphate ion concentration is less than 5 g/l, a ununiform coating film is apt to be formed and, if it exceeds 40 g/l, elevation of the effect can not be expected and an using amount of chemicals becomes large causing an economical disadvantage.

If a concentration of the coating film-converting accelerator (a) is lower than said range, sufficient coating film conversion is not possible on an iron-based surface and yellow rust is easily formed and, if it is over said range, a ununiform coating film of a blue color type is easily formed on an iron-based surface.

The FA is defined by a ml amount of a 0.1 N-NaOH consumed to neutralize 10 ml of the treating solutions using bromophenol blue as an indicator. If the FA is less than 0.5, an uniform zinc phosphate coating film is not formed on an aluminum-based surface and, if it exceeds 2.0, a zinc phosphate coating film containing the $Na_3AlF_6$ component is formed on an aluminum-based surface and the corrosion-resistance sometimes lowers.

Also, treating solutions for forming a zinc phosphate coating film using in the present invention are desired to contain a manganese ion and a nickel ion in a specially defined concentration range, besides said main components. The manganese ion prefers to be in a range of 0.1~3 g/l and more prefers to be in a range of 0.6~3 g/l. If it is less than 0.1 g/l, adhesion with a zinc-based surface and an an effect upon elevating the warm brine-resistance become insufficient and also, if it exceeds 3 g/l, an effect upon elevating the corrosion-resistance becomes insufficient. The nickel ion prefers to be in a range of 0.1~4 g/l and more prefers to be in a range of 0.1~2 g/l. If it is less than 0.1 g/l, an effect upon elevating the corrosion-resistance becomes insufficient and also, if it exceeds 4 g/l, there is a trend that the effect upon elevating the corrosion-resistance decreases.

The treating solutions for forming a zinc phosphate coating film using in the present invention, furthermore in case of necessity, may contain a coating film-converting accelerator (b). As the coating film-converting accelerator (b) are cited, for example, a nitrate ion and a chlorate ion, etc. The nitrate ion prefers to be in a range of 0.1~15 g/l and more prefers to be in a range of 2~10 g/l. The chlorate ion prefers to be in a range of 0.05~2.0 g/l and more prefers to be in a range of 0.2~1.5 g/l. These components may be contained by alone or in a combed use of two or more kinds. The coating film-converting accelerator (b) may be used in combination with the coating film-converting accelerator (a) or without combination with this.

A practically useful example of the treating methods in the present invention is shown as follows. A metal surface, using an alkaline degreasing agent for degreasing, is at first treated by means of spraying and/or dipping at 20°~60° C. for 2 minutes and rinsed with tape water. Then,. the metal surface, using the forementioned treating solutions for forming a zinc phosphate coating film, is treated with dipping and/or spraying at 20°~70° C. for 15 or more seconds (in the present second invention, treated with dipping for 15 seconds or more) and rinsed with tap water followed by rinsing with deionized water. In a case where the phosphating with zinc phosphate will be carried out with dipping, it is recommended that the metal surface, using a surface conditioner, is treated with spraying and/or dipping at room temperature for 10~30 seconds before the zinc phosphate treatment.

The methods for treating with zinc phosphate in the present invention may be carried out by dipping or spraying or by using both the dipping and spraying. If it is carried out with dipping, there is an advantage that an uniform coating film may be formed for a complex article having a part of bag structure etc. and for a part where the spraying can not form a coating film. Also, if it is carried out with spraying, there is an advantage in an equipment cost and an efficiency of production, etc. Besides, if the spraying is carried out after the dipping, a coating film based on zinc phosphate is surely formed and, in addition, an insoluble precipitate formed is surely removed.

Also, when the methods for treating with zinc phosphate of the present invention are carried out with spraying, it is preferred that, among the main components in using treating solutions for forming a zinc phosphate coating film, the concentrations of components other than the simple fluoride, fluoride complex, and active fluorine are maintained, for example, as seen in Japanese Official Patent Gazette, shows 55-5590, so as to have the zinc ion in a concentration of 0.3 g/l or more, the phosphate ion in that of 5 g/l or more, and the nitrite ion in a concentration range of 0.02~0.5 g/l as well as to have a mole ratio of the phosphate ion to the nitrate ion in a value of 1 to 0.7~1.3 and a mole ratio of the phosphate ion to the zinc ion in a value of 1 to 0.116 or less and, furthermore, it is prefered to keep the pH of the treating solutions in a range of 3.3~3.8.

In addition to that an expected effect of the present invention is attained by keeping the formentioned concentration ranges, and, even if by spraying, conversion on a metal surface of a zinc phosphate-based coating film which is used as a coating substrate becomes better and, furthermore, the consumption of a nitrite salt is reduced to an amount of one half or less when it is compared to that in a case of the hitherto known treating solution, and not only the byproduct sludge is improved in quality, but also its generating amount can be reduced to an amount of one third~one fourth.

Of cource, in case where the method for treating with zinc phosphate of the present invention is carried out with the spraying using a treating solution for forming a zinc phosphate coating film which is commonly sued for spraying, it is sufficient if the concentrations of the simple fluoride, fluoride complex, and active fluorine in said treating solution are adjusted in the above specially defined ranges. With doing this, an expected effect of the present invention is attained.

As an suppling source for the above-described components are used, for example, the following chemicals.

Zinc ion
- zinc oxide, zinc carbonate, and zinc nitrate etc.

Phosphate ion
- phosphoric acid, zinc phosphate, and manganese phosphate etc.

Coating film-converting accelerator (a)
- nitrous acid, sodium nitrite, ammonium nitrite, sodium m-nitrobenzenesulfonate, and hydrogen peroxide etc.

Manganese ion
- manganese carbonate, manganese nitrate, manganese chloride, and manganese phosphate etc.

Nickel ion
- nickel carbonate, nickel nitrate, nickel chloride, nickel phosphate, and nickel hydroxide etc.

Nitrate ion
- nitric acid, sodium nitrate, ammonium nitrate, zinc nitrate, manganese nitrate, and nickel nitrate etc.

Chlorate ion
- sodium chlorate and ammonium chlorate etc.

When the method for treating with zinc phosphate of the present invention are carried out, a preferable temperature of the treating solutions is in a range of 20°~70° C. and a more preferable one is in a range of 35°$\alpha$° C. If the temperature is lower than the range, the coating film conversion is bad and treating for a long period of time is required. Also, if it is higher than the range, balance of the treating solutions is easily lost due to decomposition of the coating film-converting accelerator and generation of a precipitate in the treating solutions, so that good coating film is hard to get.

A treating period of time with the treating solutions for forming a zinc phosphate coating film prefers to be 15 second or more, more preferably, to be 30~120 seconds. If it is less than 15 seconds, a coating film having desirable crystals may not sufficiently be formed. Besides, in a case where an article having a complex shape like an automobile body is treated, treatment in combination of dipping and spraying is practically preferred and, in this case, for example, at first the dipping for 15 or more seconds, preferably, for a period of 30~120 seconds is carried out and, subsequently, the spraying for two or more seconds, preferably, for a period of 5~45 seconds may be carried out. Besides, to wash off the sludge attached during the dipping, spraying for a period of time as long as possible is preferred.

Therefore, the methods for treating with zinc phosphate of the present invention involves the dipping and spraying as well as treating embodiments in combination of these.

The treating solutions for forming a zinc phosphate coating film using in the present invention is simply obtained by that an original solution of high concentration is beforehand arranged so as to usually contain each component in an amount larger than a wanted amount and it is diluted with water or by other means to adjust the containing component in a defined amount.

There are solutions of an one-solution type and a two-solution type as the original solution of high concentration, and the solutions of following embodiments are practically used.

(1) A concentrated original solution of the one-solution type containing a zinc ion source and a phosphate ion source in a mixing state so as to be both the ions in a weight ratio range of 1 (zinc ion) to 2.5~400 (phosphate ion) in their ionic forms.

(2) a concentrated original solution of the one-solution type as described in said (1), which further contains the coating film-converting accelerator (b), of which coexistence under the conditions of the original solution does not cause any interference.

Moreover, a concentrated original solution of the one-solution type may contain a proper compound among a source compound for supplying said nickel ion, a source compound for supplying the manganese ion, a source compound for supplying the simple fluoride, and a source compound for supplying the fluoride complex etc.

(3) A concentrated original solution of the two-solution type which is composed of the A solution containing at least a source for supplying the zinc ion and a source for supplying the phosphate ion and the B solution containing at least said coating film-converting accelerator (a), and it is used so as to have the source for suppling the zinc ion and the source for supplying the phosphate ion in a range of 1 to 2.5~400 in a weight ratio of their ionic forms.

As a compound being contained in the B solution is cited such a compound as said coating film-converting accelerator (a) etc., of which coexistence under the conditions of an original solution cause interferences with the source for supplying the zinc ion and the source of supplying the phosphate ion. Also, in the present second invention, a compound using as a source for supplying the simple fluoride or preferably, a concentrated source solution containing said compound (C solution) is arranged and provided for use in an outside of the treating bath.

Said concentrated original solutions usually contain each component so as to use them by diluting 10~100 times (in a weight ratio) in a case of the one-solution type, 10~100 times (in a weight ratio) in the A solution, 100~1000 times (in a weight ratio) in the B solution, and 10~100 times (in a weight ratio) in the C solution.

In a case of the two-solution type consisting of said A and B solutions, compounds may be placed separately, of which coexistence is not good under the conditions of an original solution.

In a case of the two-solution type, a source for supplying the zinc ion, a source for supplying the phosphate ion, a source for supplying the nitrate ion, a source for supplying the nickel ion, a source for supplying the manganese ion, a source for supplying the simple fluoride (in the present second invention, if necessary), and a source for supplying the fluoride complex are contained in the A solution. A source for supplying the chlorate ion may be contained in either the A solution or the B solution. A source for supplying the nitrite ion, a source for supplying the m-nitrobenzenesulfonate ion, and a source for supplying hydrogen peroxide are contained in the B solution.

Besides, in a case where the A solution contains the source for supplying the manganese ion, a source for supplying the chlorate ion prefers to be contained in the B solution.

Since a component in treating solutions for forming a zinc phosphate coating film is unevenly consumed during the treating with zinc phosphate, it is necessary to replenish the component in a consumed amount. A concentrated solution for this replenishing is, for example, in a concentrated original solution of the one-solution type, The A solution, B solution, and C solution, and the one wherein each component is arranged varying ratio according to the consumed amount.

According to the present first invention, when a metal surface is treated with zinc phosphate, the concentrations of the simple fluoride, fluoride complex, and active fluorine are adjusted in the specially defined range. Thus, when an aluminum-based surface is treated, aluminum ions forms a precipitate of a sedimentation character and can be easily removed. Because of this, even in repeating treatment, the aluminum-based surface is treated with zinc phosphate maintaining good conditions and, when an aluminum-based surface and iron-based surface are treated with the same treating solution, bad conversion on the iron-based surface does not take place. Since said treating solution contains the active fluorine, the iron-based surface and zinc-based surface are both treated with zinc phosphate equally. Therefore, according to a method of the present first invention, an iron-based surface, zinc-based surface, and an aluminum-based surface as well as a metal surface which is made of combining these two or more kinds of surfaces can be treated with the same treating solution, whereby is made a zinc phosphate-based coating film of superior adhesion, warm brine-resistance, and scab-resistance. Besides, since $Na_3AlF_6$ does not mingle with the zinc phosphate coating film, an after-treatment by a rinsing agent containing chromium (VI) for preventing a decrease of corrosion-resistance of the film is unnecessary.

In the present second invention, since the aluminum ions are precipitated in an outside of a treating bath and a precipitate thus-formed is separated from the treating solution, the method for precipitating and separating it can be properly chosen. There are, for example, a method for separating a precipitate of a gravity type, a filtration method of a pressurizing type, a mechanical filtration method, and others. There may be formed a precipitate in a bath for precipitating and then separated the precipitate in a bath for separating a precipitate, and carried out the forming and separating of a precipitate in the same bath (for example, a bath for precipitating).

Also, in order to lead the treating solution existing in a treating bath to an outside of the treating bath and, after formation and separation of a precipitate, return the solution into the treating bath, pumping out by a pump and overflowing may be suitable used.

According to the second invention, the aluminum ions dissolved in a treating solution, when a metal surface, especially, a metal surface including an aluminum-based surface is treated with zinc phosphate, cause inferior conversion as the aluminum ion concentration increases, but with an addition of a simple fluoride a precipitate is selectively formed. If such a precipitate is formed in a treating bath, it attaches to a treating object damaging uniformity of a coating film. Therefore, in the present second invention, the treating solution is led to an ouside of a treating bath and the aluminum ions in the treating solution are selectively precipitated by addition of the simple fluoride in an outside of a treating bath. By returning the treating solution, from which a precipitate thus-formed is separated, into a treating bath, loss of components besides the aluminum ions can be prevented. Also, by carrying out the removal of aluminum ions in the treating solution in an outside of a treating bath, attaching of a precipitate to a treating object is prevented and, even if the treating is repeated many times, an aluminum-based surface is well treated with zinc phosphate and, when an aluminum-based and iron-based surfaces are treated with the same treating solution, inferior conversion on the iron-based surface is prevented. Since said treating solution contains active fluorine, both the iron-based and zinc-based surfaces can equally be treated with zinc phosphate. Thus, according to the present second invention, an iron-based, zinc-based, and aluminum-based surfaces as well as a metal surface composed of combination of these two or more surfaces can be treated with the same treating solution, and a zinc phosphate-based coating film of high adhesion, warm brine-resistance, and high scab-resistance is formed. Also, since the $Na_3AlF_6$ does not mingle with a zinc phosphate coating film, after-treatment by a rinsing agent containing chromium (VI) is unnecessary, which is applied for preventing a decrease of corrosion-resistance of the coating film.

In the present second invention, when the concentration of aluminum ions in equilibrium in a treating solution in a treating bath is maintained at a value of 150 ppm or less, a superior coating film of high corrosion-resistance can be formed continuously and under a stable condition on an aluminum-based surface and an iron-based and/or zinc-based surfaces.

In the present second invention, if the aluminum ions in a treating solution is precipitated by adjusting the mole ratio of the fluoride complex to the simple fluoride at a value of 0.5 or less and the concentration of active fluorine at a value of 40 μA or more indicated by a silicon electrode meter, a precipitate of good sedimentation character is formed and a removing operation for the precipitate is easy to carry out.

If a treating solution (2) in a treating bath is adjused in concentration so as to contain the simple fluoride in a range of 200~300 mg/l upon converting into a HF concentration and the fluoride complex in a range of:

$$\frac{\text{fluoride complex}}{\text{simple fluoride}} \geqq 0.01$$

in a mole ratio of the fluoride complex to the simple fluoride and, if the active fluorine concentration is adjusted so as to be in a range of 15~40 μA at a value indicated by a silicon electrode meter, a zinc phosphate coating film which is suitable for electrocoating, shows high corrosion-resistance, and is superior in adhesion can be formed regardless of the kind of a substrate metal on an iron-based, zinc-based, and an aluminum-based surfaces as well as a metal surface having jointly these two or more surfaces.

Since the treating solution for forming a zinc phosphate coating film, which is sued for treating a metal surface, is adjusted at said specially defined simple fluoride, fluoride complex, and active fluorine concentrations, the method for treating a metal surface with zinc phosphate relating to the present first invention is able to form, under a stable condition, a zinc phosphate coating film, which is suitable for coating, in particular, for electrocoating and shows high corrosion-resistance irrespective of the kind of substrate metals, on an iron-based, zinc-based, and an aluminum-based surfaces as well as a metal surface having these two or more in combination.

The method for treating a metal surface with zinc phosphate relating to the present second invention is arranged so as to precipitate and separate aluminum ions in the treating solution in the outside of a treating bath and, therefore, for an iron-based, zinc-based, and an aluminum-based surfaces as well as a metal surface having these two or more in combination at the same time, the treating can be carried out using the same treating solution for forming a zinc phosphate coating film and, even if it is repeated many times, a coating film of superior adhesion and high corrosion-resistance can be formed under a stable condition and besides, formation of a precipitate in a treating bath from metal ions dissolving out from a metal surface of a treating object, especially, formation of that from alluminum ions can be prevented.

DESCRIPTION OF THE PREFERRED EMBODIMENT

Hereinafter, the present second invention is explained with referring to the outline diagrams of an equipment used in practice.

Figure 1:
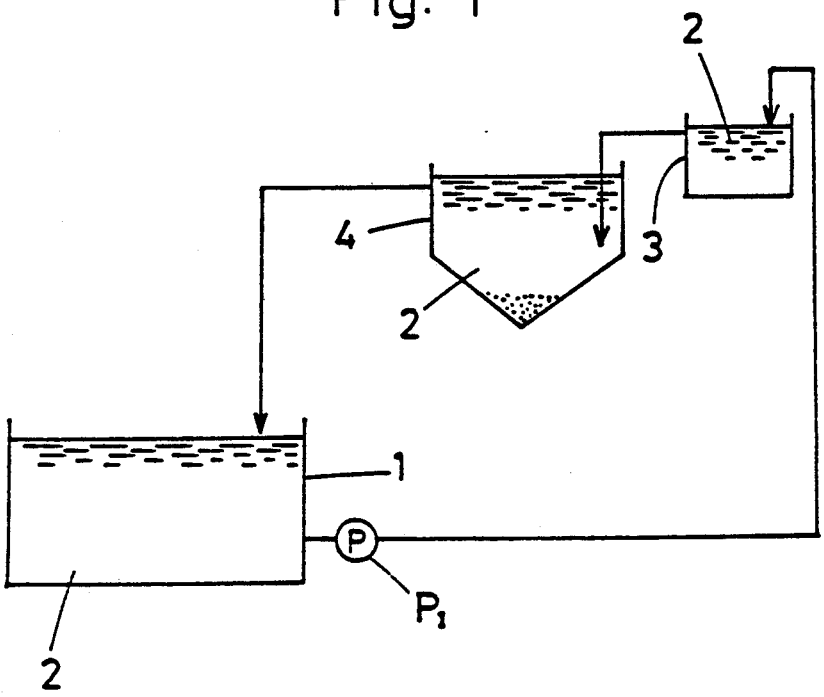
FIG. 1 is an outline diagram showing one example of an equipment which is used in carrying out the method for treating (phosphating) a metal surface with zinc phosphate relating to the present second invention.

FIG. 1 is an outline diagram showing an example of the equipment which is used in carrying out the method for treating (phosphating) a metal surface with zinc phosphate relating to the present second invention. As seen in this diagram, into the treating bath 1 is placed the treating solution 2, in which a metal surface is dipped. In this treating bath 1, a sensor (which is not shown in the diagram) is set to survey the concentration of aluminum ions and the pump $P_1$ is arranged to pump out continuously or intermittently the treating solution 2 in the treating bath 1, when the concentration of aluminum ions reaches a certain degree. The treating solution 2 pumped out is led to the bath for precipitating 3, to which a simple fluoride is added. Concentration of the simple fluoride at this time is set, for example, as described above. By doing this, the aluminum ions form sludge containing aluminum. The treating solution 2 containing the sludge containing aluminum is led to the bath for separating the precipitate 4 and the sludge containing aluminum is separated, for example, according to the forementioned manner and then, this treating solution 2 is returned to the treating bath 1.

Besides, the bath for precipitating 3 and the bath for separating the precipitate 4 are separately settled, but the precipitate separation may be carried out in the bath for precipitating 3.

Hereinafter, the practical examples of the present invention and the examples for comparison are presented, but the present invention is not limited within the undermentioned examples.

First, examples and examples for comparison of the present first inventoin are shown.

EXAMPLES 1~5 AND EXAMPLES FOR COMPARISON 1~8

| Metals for treating (phosphating) and proportion of treating area | | |
|---|---|---|
| (A) | Cold-rolled steel plate | 20% |
| (B) | Hot dipped zinc plated steel plate | 50% |
| (C) | Alumimum-alloy plate (based on an Aluminum-Magnesium alloy) | 30% |
| Total area 0.07 $m^2$ per one time | | |

Treating solution for forming a zinc phosphate coating film

Solutions having the compositions shown in Table 1 were used and the volume of treating solutions was 5 liters.

Treating process

The above-described three kinds of metal surfaces were treated through the following processes at the same time; (a) degreasing→(b) rinsing→(c) surface-conditioning→(d) converting treatment (dipping treatment→(e) rinsing→(f) rinsing with deionized water→(g) drying→(h) coating; whereby metal plates coated with obtained.

Besides, in the process of (d) converting treatment, the converting properties of a coating film at an initial period (at a time of the first zinc phosphate treatment) and at some passage of time (at the 150th zinc phosphate treatment), concentration of the aluminum ion in equilibrium as well as properties of the sludge containing aluminum ions were investigated.

Evaluation of coating film-converting

Double circle ◎ . . . an uniform and fine crystalline zinc phosphate coating film was formed.

Single circle ○ . . . an unfirm zinc phosphate coating film was formed.

Cross X . . . an uniformity-lacking coating film (wherein a mixing case of $Na_3AlF_6$ is involved) or a coating film was not formed at all.

Evaluation of sludge containing aluminum ions

Double circle ◎ . . . good sedimentation character

Single circle ○ . . . sedimentation character

Cross X . . . floating and suspending character

Treating conditions (a) Degreasing

Using an alkaline degreasing agent (Surf-cleaner SD 250, made by Nippon Paint Co., Ltd.) in a concentration of 2% by weight, dipping was carried out at 40° C. for 2 minutes. During this period, the bath was controlled maintaining the alkaline degree at the initial value (the alkaline degree is determined with a ml amount of 0.1 N-HCl which is required for neutralization of a 10 ml bath using bromophenol blue as an indicator). A reagent for replenishing was the Surf-cleaner SD250.

(b) Rinsing

Using tap water, washing by spraying due to a water-pressure was carried out.

(c) Surface-conditioning

Using a surface-conditioning agent (Surf-fine 5N-5, made by Nippon Paint Co., Ltd.) in a concentration of 0.1% by weight, dipping treatment was carried out at room temperature for 15 seconds. The bath was controlled by maintaining the alkaline degree by supplying the Surf-fine 5N-5.

(d) Converting treatment (dipping treatment)

Using said treating solution for forming a zinc phosphate coating film, dipping treatment was carried out at 40° C. for 2 minutes. The bath was controlled by maintaining the concentration of each ion composition and the free acidity (the acidity is determined with a ml amount of 0.1 N-NaOH which is required for neutralization of a 10 ml bath using bromophenol blue as an indicator) in said treating solution for forming a zinc phosphate coating film at the initial value. As reagents for replenishing were a concentrated treating agent for replenishing A containing zinc white, phosphoric acid, manganese nitrate, nickel carbonate, fluorosilicic acid, and nitric acid in order to maintain the concentration of each of the Zn, $PO_4$, Mn, Ni, F, and $NO_3$ ions, respectively, and a concentrated treating agent for replenishing B containing sodium nitrite to maintain the concentration of $NO_2$ ions, and a replenishing agent C containing hydrofluoric acid to control the concentration of active fluorine using a silicon electrode meter (Surf Proguard 101N, made by Nippon Paint Co., Ltd.).

(e) Rinsing

Using tap water, rinsing was carried out at room temperature for 15 seconds.

(f) Rinsing with deionized water

Using ion-exchange water, dipping was carried out at room temperature for 15 seconds.

(g) Drying

Using hot air, drying was carried out at 100° C. for 10 minutes.

(h) Coating

Using a cationic electrocoating paint (Powertop U-1000, made by Nippon Paint Co., Ltd.), a cationic electrocoating was carried out to make a film of thickness 30 μm according to a standard method, on which intermediate and top coats were carried out by using a melaminealkyd-based intermediate and top coating paint, made by Nippon Paint Co., Ltd., to make films of thickness 30 and 40 μm.

For the coated metal plates thus-obtained, the properties of coated films were investigated and evaluated as follows.

Double circle ◎ . . . all the properties such as warm brine resistance, water-resistant secondary adhesion, and scab-resistance were superior.

Single circle ○ . . . in practice, no problem in properties.

Cross X . . . in practice, there was found a problem or problems in any one or more of said properties.

The forementioned results are shown in Table 2.

TABLE 1

| | | example | | | | | example for comparison | | | | | | | |
|---|---|---|---|---|---|---|---|---|---|---|---|---|---|---|
| | | 1 | 2 | 3 | 4 | 5 | 1 | 2 | 3 | 4 | 5 | 6 | 7 | 8 |
| Main composition | Zn ion [g/l] | 1.0 | 1.0 | 1.0 | 1.0 | 1.0 | 1.0 | 1.0 | 1.0 | 1.0 | 0.7 | 0.7 | 0.5 | 1.8 |
| of treating solution | $PO_4$ ion [g/l] | 14.0 | 14.0 | 14.0 | 14.0 | 14.0 | 14.0 | 14.0 | 14.0 | 14.0 | 10.0 | 8.0 | 8.0 | 10.0 |
| for forming zinc | Mn ion [g/l] | 0.8 | 0.8 | 0.8 | 0.8 | 0.8 | 0.8 | 0.8 | 0.8 | 0.8 | 1.2 | — | — | — |

TABLE 1-continued

| | | example | | | | | example for comparison | | | | | | | |
|---|---|---|---|---|---|---|---|---|---|---|---|---|---|---|
| | | 1 | 2 | 3 | 4 | 5 | 1 | 2 | 3 | 4 | 5 | 6 | 7 | 8 |
| phosphate coating film | Mg ion [g/l] | — | — | — | — | — | — | — | — | — | — | — | — | 3.0 |
| | Ni ion [g/l] | 0.8 | 0.8 | 0.8 | 0.8 | 0.8 | 0.8 | 0.8 | 0.8 | 0.8 | 0.8 | 0.8 | 0.2 | 1.5 |
| | HF [mg/l] | 400 | 250 | 500 | 400 | 400 | — | 400 | 140 | 600 | *420 | *980 | *140 | *480 |
| | $H_2SiF_6$ [mg/l] | 500 | 800 | 200 | 1420 | 60 | 1000 | 2000 | 800 | 750 | — | — | 60 | 800 |
| | $NO_2$ ion [g/l] | 0.15 | 0.15 | 0.15 | 0.15 | 0.15 | 0.15 | 0.15 | 0.15 | 0.15 | 0.1 | 0.1 | 0.1 | 0.1 |
| | $NO_3$ ion [g/l] | 4.0 | 4.0 | 4.0 | 4.0 | 4.0 | 4.0 | 4.0 | 4.0 | 4.0 | 3.0 | 1.6 | 1.6 | 8.0 |
| | $ClO_3$ ion [g/l] | 0.1 | 0.1 | 0.1 | 0.1 | 0.1 | 0.1 | 0.1 | 0.1 | 0.1 | — | — | — | — |
| Total acidity (point) | | 23.5 | 21.9 | 23.6 | 24.7 | 22.9 | 22.1 | 25.4 | 21.3 | 24.8 | 21.6 | 20.0 | 20.0 | 31.4 |
| Free acidity (point) | | 1.0 | 0.9 | 1.0 | 0.5 | 1.5 | 0.9 | 1.1 | 1.0 | 1.0 | 1.3 | 0.8 | 1.5 | 2.8 |

(Note)
*are concentrations upon converting the $NH_4HF_2$ into HF.
$NH_4HF_2$: Example for comparison 5; 600 mg/l, example for comparison 6; 1400 mg/l, example for comparison 7; 200 mg/l, example for comparison 8; 680 mg/l.

TABLE 2

| | example | | | | | example for comparison | | | | | | | |
|---|---|---|---|---|---|---|---|---|---|---|---|---|---|
| | 1 | 2 | 3 | 4 | 5 | 1 | 2 | 3 | 4 | 5 | 6 | 7 | 8 |
| control of concentrations of fluoride | | | | | | | | | | | | | |
| simple fluoride (mg/l)* | 400 | 250 | 500 | 400 | 400 | — | 400 | 140 | 600 | 420 | 980 | 140 | 480 |
| fluoride complex (mg/l) | 500 | 800 | 200 | 1420 | 60 | 1000 | 2000 | 800 | 750 | — | — | 60 | 800 |
| $\frac{\text{fluoride complex}}{\text{simple fluoride}}$ (mole ratio) | 0.17 | 0.43 | 0.06 | 0.48 | 0.02 | — | 0.67 | 0.77 | 0.17 | — | — | 0.06 | 0.23 |
| value indicated by silicon electrode meter (μA) | 60 | 25 | 110 | 30 | 120 | — | 50 | 10 | 180 | 10 | 200< | 10 | 200< |
| coating film-converting at intitial period | | | | | | | | | | | | | |
| aluminum | ◎ | ◎ | ◎ | ◎ | ◎ | ◎ | ◎ | ◎ | x | x | x | x | x |
| iron, zinc | ◎ | ◎ | ◎ | ◎ | ○ | ◎ | ◎ | ◎ | ○ | ○ | ○ | ○ | ○ |
| inside part of bag structure | ◎ | ◎ | ◎ | ◎ | ○ | ◎ | ◎ | ◎ | ○ | ○ | ○ | x | ○ |
| coating film-converting at some passage of time | | | | | | | | | | | | | |
| aluminum | ◎ | ◎ | ◎ | ◎ | ◎ | x | x | x | x | x | x | x | x |
| iron, zinc | ◎ | ◎ | ◎ | ◎ | ○ | x | ○ | x | ○ | ○ | ○ | x | ○ |
| inside part of bag structure | ◎ | ◎ | ◎ | ◎ | ○ | x | x | x | ○ | ○ | ○ | x | ○ |
| concentration of $Al^{3+}$ in equilibrium (mg/l) | 40 | 70 | 20 | 60 | 10 | 300< | 150< | 300< | 10 | 20 | 10> | 300< | 10> |
| properties of sludge containing $Al^{3+}$ | ◎ | ○ | ◎ | ○ | ◎ | x | x | x | ◎ | ◎ | ◎ | x | ◎ |
| coating film properties | | | | | | | | | | | | | |
| aluminum | ◎ | ◎ | ○ | ◎ | ○ | x | x | x | x | x | x | x | x |
| iron, zinc | ◎ | ◎ | ◎ | ○ | ○ | x | ○ | x | ○ | ○ | ○ | x | x |

(Note)
*A concentration of HF or a concentration converted into HF.

As seen in Table 2, the following results were obtained.

In the example 1, superior coating film-converting was shown in the tree kinds of metals and also, the coating film-converting was good inside a part of bag structure. During the passing time in succesive treatment, aluminum ions dissolved in the treating solution converted into sludge of better sedimentation character than that of the example 2 and were easily removed out of the reaction system, so that superior conversing was able to be maintained. Coating film properties in the three kinds of metals were all good.

In the example 2, although the equilibrium concentration of aluminum ions become to 70 ppm, superior converting and coating film properties were successively obtained for the three kinds of metals. Also, inside a part of bag structure the coating film-converting was good.

In the example 3, although compared with the examples 1 and 2 the warm brine-resistance on an aluminum-based surface was a little inferior, properties having no problem in practice were obtained. Similar to the example 1, superior converting and coating film properties were successively obtained in the other kinds of metal surfaces. Also, inside a part of bag structure the coating film-converting was good.

In the example 4, although the equilibrium concentration of aluminum ions became to 60 ppm, superior converting was successively obtained for the three kinds of metals. Also, inside a part of bag structure the coating film-converting was good. However, although compared with the example 1~3 the scab-resistance on the iron-based surface was somewhat inferior, properties having no problem in practice were obtained. Similarly to the case of example 1, superior coating film properties were successively obtained in the other kinds of metal surfaces.

In the example 5, although compared with the examples 1~4 the converting properties on the iron-based and zinc-based surfaces and inside a part of bag structure were somewhat inferior, properties having no problem in practice were obatined and superior converting was successively obtained in the aluminum-based surface. Regarding the coating film properties, although compared with the examples 1 and 2 warm brine-resistance on the aluminum-based surface and the warm brine-resistance on the iron-based and zinc-based surfaces were somewhat inferior, properties having no problem in practice were obtained.

In the example for comparison 1, although at the initial period superior converting was shown for the three kinds of metals as well as inside a part of bag structure, the aluminum concentration in the treating bath became over 300 ppm with the passage of time in succesive treatment and inferior coating film-conversion took place. Also, the coating film properties of all the three kinds of metals became very inferior. Furthermore, properties of the sludge containing aluminum ions were of floating and suspending, so that the sludge removal was difficult.

In the example for compariosn 2, although superior converting was shown at the initial period similarly to the case of example 1, the equlibrium concentration of aluminum ions exceeded 150 ppm and the coating film-converting and the coating film properties (particularly, the scab-resistance) on the aluminum-based surface became very inferior. Properties of the sludge containing aluminum ions were of floating and suspending.

The example for comparison 3 gave the same results to those from the example for comparison 1.

In the example for comparison 4, since the $Na_3AlF_6$ component mingled with the zinc phosphate coating film on the aluminum-based surface, the warm brine-resistance on the aluminum-based surface was inferior.

In the example for comparison 5, since the $Na_3AlF_6$ component mingled with the zinc phosphate coating film on the aluminum-based surface similarly to the example for comparison 4, the warm brine-resistance was inferior.

The example for comparison 6 showed inferior warm brine-resistance similarly to the examples for comparison 4 and 5.

The example for comparison 7 showed no formation of the zinc phosphate coating film on the aluminum-based surface and no formation of a $Na_3AlF_6$ coating film. Also, the converting inside a part of bag structure was inferior.

During the passage of time the equlibrium concentration of aluminum ions exceeds 300 ppm, so that the converting and coating film properties became inferior for all the three kinds of metals.

In the example for comparison 8 since the $Na_3AlF_6$ component mingled with the zinc phosphate coating film on the aluminum-based surface similarly to the examples for comparison 5 and 6, the warm brine-resistance on this surface was inferior. Also, the warm brine-resistance on the iron-based surface was inferior.

Next, examples and examples for comparison of the present second invention are shown.

EXAMPLES 6~8

| Metal for treating and proportion of treating area | | |
|---|---|---|
| (D) | Cold-rolled steel plate | 20% |
| (E) | Hot dipped zinc alloy plated steel plate | 50% |
| (F) | Aluminum alloy plate (Al/Mg alloy-based) | 30% |
| Total area 0.5 $m^2$/hour | | |

Treating solution

Solutions having the compositions shown in Table 3 were used. Besides, the volume of treating solutions was 16 liters.

Treating process

The forementioned three kinds of metal surfaces (D)~(F) were simultaneously treated according to the following processes; (a) degreasing→(b) rinsing→(c) surface-conditioning→(d) converting (dipping treatment)→(e) rinsing→(f) rinsing with deionized water→(g) drying→(h) coating; whereby metal plates coated were obtained.

Besides, in the converting process (d), the converted character and the sludge accumulation in the treating bath were examined and the results obtained are shown in Table 4. Furthermore, the concentrations of sludge, aluminum ions, and active fluorine, and a ratio of the fluoride complex to the simple fluoride (mole ratio) in the baths for treating, for precipitating, and for separating a precipitate are also shown in Table 4. Besides, the concentrations of sludge and aluminum ions in the bats for precipitating and for separating a precipitate are values observed at the exit sides of the baths.

Evaluation of converted character

Double circle ◎ . . . a uniform and fine crystalline zinc phosphate coating film was formed.

Single circle ○ . . . a uniform zinc phosphate coating film was formed.

Cross X . . . a uniformity-lacking coating film (including a case where $Na_3AlF_6$ mingles) was formed or any coating film was not formed.

Evaluation of sludge accumulation in treating bath

Double circle ◎ . . . sludge-accumulation was not recognized.

Single circle ○ . . . an accumulating trend of sludge was small.

Cross X . . . an accumulating trend of sludge was large.

Treating condition (a) Degreasing

Using an alkaline degreasing agent (Surf-cleaner SD 250, made by Nippon Paint Co., Ltd.) in a concentration of 2% by weight, dipping was carried out at 40° C. for 2 minutes. Controlling of a bath during this treatment was carried out by maintaining an alkaline degree at the initial value. Chemicals for replenishing use were the Surf-cleaner SD250.

(b) Rinsing

Using tap water, washing by spraying by a water pressure was carried out.

(c) Surface-conditioning

Using a surface-conditioner (Surf-fine 5N-5, made by Nippon Paint Co., Ltd.) in a concentration of 0.1% by weight, dipping was carried out at room temperature for 15 seconds. Controlling of a bath was carried out by maintaining an alkaline degree with a supply of the Surf-fine 5N-5.

(d) Converting (dipping treatment)

Using the equipment shown in FIG. 1, the converting was carried out by dipping an object metal for 2 minutes in said treating solution 2 which was placed in a 10 liters-volume treating bath 1. Temperature of the treating solution was 40° C. Controlling of the bath in the treating bath 1 was carried out by maintaining he concentrations of ion components and the free acidity in said treating solution at the initial values. In order to maintain the concentrations of each of the ions, Zn, $PO_4$Mn, Ni, $NO_3$and silicofluoride, a concentrated treating agent for replenishing A' containing zinc white, phosphoric acid, manganese nitrate, nickel carbonate, nitric acid, and hydrosilicofluoric acid was directly added into the treating bath, and also in order to maintain the $NO_2$ ion concentration, a concentrated treating agent for replenishing B' containing sodium nitrite was directly added into the treating bath. Besides, in order to precipitate aluminum ions in an outside of the treating bath 1 as well as to maintain the active fluorine concentration in the treating bath in such the value range as shown in Table 1, which are indicated by a silicon electrode meter (Surf Proguard 101 N, made by Nippon Paint Co., Ltd.), a concentrated treating gent for replenishing C' containing acid sodium fluoride was added to the bath for precipitating 3.

During the converting, the treating solution 2 was pompted out by the pump $P_1$ from the treating bath 1 and led to the bath for precipitating (1 liter volume) 3 and, into this treating solution 2 was added the concentrated treating agent for replenishing C' containing acid sodium fluoride. This treating solution 2 was led to the bath for separating the precipitate (5 liter volume) 4 wherein the precipitate was separated from the treating solution using a precipitate-separating method of an upward current type. This treating solution was returned to the treating bath 1.

Besides, the treating solution was continuously circulated at a speed of 0.18 liter per minute through the following pathway: the treating bath 1→bath for precipitating 3→bath for separating a precipitate 4→treating bath 1.

(e) Rinsing

Using tap water, rinsing was carried out at room temperature for 15 seconds.

(f) Rinsing with deionized water

Using ion-exchange water, dipping was carried out at room temperature for 15 seconds.

(g) Drying

It was carried out with a hot wind of 100° C. for 10 minutes.

(h) Coating

Using a cationic electrocoating paint (Power Top U-1000) made by Nippon Paint Co., Ltd., cationic electrocoating (film thickness 30 μm) was carried out according to a common method and, on this coated film, an intermediate coating and a top coating (film thickness were 30 and 40 μm, respectively) were carried out, according to a common method, using a melaminalkyd-based intermediate and top coating paint made by Nippon Paint Co., Ltd.

For the coated metal plates thus-obtained, the coating properties were examined and evaluated as follows.

Double circle ◎ . . . coating films are very good in the outlook and corrosion-resistance.

Single circle ○ . . . coating films are good in the outlook and corrosion-resistance.

Cross X . . . coating films are abnormal in the outlook and inferior in the corrosion-resistance.

EXAMPLE FOR COMPARISON 9

Figure 2:
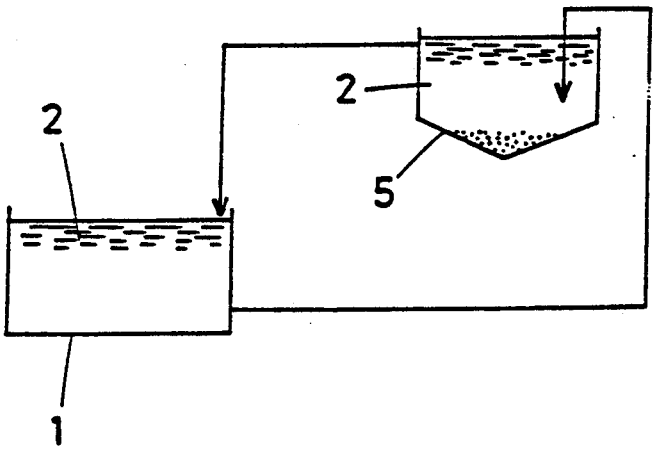
FIG. 2 is an outline diagram showing an equipment which is used in an example for comparison 9.

The procedure of example 6 was repeated except that the equipment shown in FIG. 2 was used, composition of treating solution was as shown in Table 3, the concentrated treating agent for replenishing C' was added to the treating bath 1, and the aluminum ion was precipitated in an inside of the treating bath 1 to separate a precipitate thus-formed in the bath for separating a precipitate 5 (5 liter volume), whereby coating plates were obtained.

Results thus-obtained are shown in Table 4.

TABLE 3

| main composition of treating solution placed in a treating bath | example 6 and example for comparison 9 | example 7 | example 8 |
|---|---|---|---|
| Zn ion [g/l] | 1.0 | 1.0 | 1.0 |
| $PO_4$ ion [g/l] | 14.0 | 14.0 | 14.0 |
| Mn ion g/l] | 0.8 | 0.8 | 0.8 |
| NI ion [g/l] | 0.8 | 0.8 | 0.8 |
| HF [g/l] | 0.2 | 0.3 | 0.25 |
| $H_2SiF_6$ [g/l] | 0.5 | 0.5 | 1.0 |
| $NO_2$ ion [g/l] | 0.15 | 0.15 | 0.15 |
| $NO_3$ ion [g/l] | 4.0 | 4.0 | 4.0 |
| $\frac{(H_2SiF_6)}{(HF)}$ (mole ratio) | 0.35 | 0.23 | 0.56 |
| total acidity (point) | 22.5 | 23.0 | 23.5 |
| free acidity (point) | 0.8 | 0.8 | 0.8 |
| concentration of active fluorine (value indicated by silicone electrode meter) [μA] | 15~20 | 30~40 | 15~20 |

TABLE 4

| | | example 6 | example 7 | example 8 | example for comparison 9 |
|---|---|---|---|---|---|
| treating bath | concentration of sludge [ppm] | 150 | 250 | 260 | 30 → 500 |
| | concentration of aluminum ion [ppm] | 24 | 9 | 114 | 100 → 40 |
| | concentration of active fluorine value indicated by silicon electrode meter [μA] | 15~20 | 30~40 | 15~20 | 15~20 |
| | $\frac{\text{fluoride complex}}{\text{simple fluoride}}$ (mole ratio) | 0.35 | 0.23 | 0.56 | 0.35 |
| bath for precipitating | concentration of sludge [ppm] | 260 | 300 | 370 | — |
| | concentration of aluminum ion [ppm] | 10 | 0 | 100 | — |
| | concentration of active fluorine value indicated by silicon electrode meter [μA] | 40 | 80~100 | 40~45 | — |
| | $\frac{\text{fluoride complex}}{\text{simple fluoride}}$ (mole ratio) | 0.29 | 0.12 | 0.45 | |
| bath for separating precipitate | concentration of sludge [ppm] | 110 | 120 | 224 | — |
| | concentration of aluminum ion [ppm] | 10 | 0 | 100 | — |
| | concentration of active fluorine value indicated by silicon electrode meter [μA] | 40 | 80~100 | 40~45 | — |

TABLE 4-continued

| | example 6 | example 7 | example 8 | example for comparison 9 |
|---|---|---|---|---|
| $\frac{\text{fluoride complex}}{\text{simple fluoride}}$ (mole ratio) | 0.29 | 0.12 | 0.45 | — |
| converted character | ◎ | ◎ | ○ | x |
| coating properties | ◎ | ◎ | ○ | x |
| sludge accumulation in treating bath | ◎ | ○ | ○ | x |

As seen in Table 4, the sludge concentration in a treating bath reached an equilibrium at 150 ppm in the example 6, at 250 ppm in the example 7, and at 260 ppm in the example 8, but an accumulating trend of the sludge in the treating bath was small, therefore, very good. During this period, the converted and coated properties in said three kinds of treated metals were good. On the other hand, in the example for comparison 9, accompanied with the progressing zinc phosphate treatment, the aluminum ion concentration increased and, when it exceeded 100 ppm, a part of the aluminum ions transformed into sludge, the active fluorine concentration rapidly reduced (O$\mu$A), and bad conversion occured. If the concentrated treating agent for replenishing C' was added to a treating bath in order to maintain the active fluorine concentration, the transforming trend of aluminum ions into sludge further increased and the sludge concentration in equilibrium in the treating bath exceeded 500 ppm. An accumulating trend of sludge in the treating bath was strong and bad. During this period, the converting character of a treating object was unstable and, especially, a ununiform coating film was formed on an aluminum alloy plate. Also, a trend that the sludge containing aluminum firmly attaches to an treating object becomes strong and the surface of an electrocoated film becomes ununiform.

What is claimed are:

1. A method for treating a metal surface with zinc phosphate, which comprises forming a zinc phosphate coating film on a metal surface containing aluminum by bringing the surface in contact with a treating solution for forming a zinc phosphate coating film, being characterized by that said treating solution is adjusted so as to contain a zinc ion in a concentration range of 0.3 to 1.5 g/l, a phosphate ion in a concentration range of 10 to 30 g/l, and a coating film-converting accelerator (a) selected from the group consisting of a nitrite ion in a concentration range of 0.01 to 0.4 g/l, a m-nitrobenzenesulfonate ion in a concentration range of 0.1 to 4 g/l, and hydrogen peroxide in a concentration range of 1 to 8 g/l upon converting into a 100% $H_2O_2$, a simple fluoride in a concentration range of 200 to 500 mg/l upon converting into a HF concentration, a fluoride complex in a concentration range of;

$$0.01 \leqq \frac{\text{fluoride complex}}{\text{simple fluoride}} \leqq 0.5 \text{ (mole ratio)}$$

and, active fluorine in a concentration range of 15 to 130 $\mu$A as a value indicated by a silicon electrode meter.

* * * * *